US006666222B1

(12) United States Patent
Fattahi et al.

(10) Patent No.: US 6,666,222 B1
(45) Date of Patent: Dec. 23, 2003

(54) ROLLING WALKER ADAPTED TO NEGOTIATE UNEVEN SURFACES

(76) Inventors: Hormoz N Fattahi, 6300 Owensmouth Ave. #F207, Woodland Hills, CA (US) 91367; Fatemeh B. Rahimian, 6300 Owensmouth Ave. #F207, Woodland Hills, CA (US) 91367

( * ) Notice: Subject to any disclaimer, the term of this patent is extended or adjusted under 35 U.S.C. 154(b) by 0 days.

(21) Appl. No.: 10/338,012

(22) Filed: Jan. 6, 2003

(51) Int. Cl.[7] ..... A63H 3/00
(52) U.S. Cl. ..... 135/67
(58) Field of Search ..... 135/67, 85; 280/87.01, 280/87.05, 87.041, 87.051, 87.021; 482/66, 68

(56) References Cited

U.S. PATENT DOCUMENTS

| | | | | | |
|---|---|---|---|---|---|
| 885,977 | A | * | 4/1908 | Brown | 280/87.01 |
| 2,652,097 | A | * | 9/1953 | Warren | 482/68 |
| 4,135,535 | A | | 1/1979 | Thomas | |
| 4,342,465 | A | * | 8/1982 | Stillings | 280/87.051 |
| 4,765,355 | A | | 8/1988 | Kent | |
| 4,893,826 | A | * | 1/1990 | Ward et al. | 280/87.021 |
| 5,020,560 | A | | 6/1991 | Turbeville | |
| 5,098,087 | A | * | 3/1992 | Matile et al. | 482/68 |
| 5,538,268 | A | * | 7/1996 | Miller | 280/87.05 |
| 5,551,105 | A | * | 9/1996 | Short | 5/87.1 |
| 5,649,558 | A | | 7/1997 | Richard | |
| 6,053,189 | A | * | 4/2000 | Longenecker et al. | 135/67 |
| 6,068,273 | A | | 5/2000 | Rao et al. | |
| 2002/0074747 | A1 | | 6/2002 | Heien | |

FOREIGN PATENT DOCUMENTS

| | | | |
|---|---|---|---|
| JP | 85498 | * | 3/2002 |

* cited by examiner

*Primary Examiner*—Janet M. Wilkens
(74) *Attorney, Agent, or Firm*—Norton R. Townsley; Belasco Jacobs & Townsley, LLP

(57) ABSTRACT

A rolling walker of the type having a frame, and a leading wheel, which has a low point, rotatably attached to the bottom of the frame at its front. The improvement comprises an intermediate wheel, which is rotatably attached to the bottom of the frame, close to and behind the leading wheel so that the low point of the intermediate wheel is lower than the low point of the leading wheel. The axle of the intermediate wheel may be lower than the axle of the leading wheel or the diameter of the intermediate wheel may be larger than the diameter of the leading wheel.

6 Claims, 4 Drawing Sheets

ROLLING WALKER ADAPTED TO NEGOTIATE UNEVEN SURFACES

CROSS REFERENCE

This application claims the benefit of Disclosure Document No. 487548 filed Jan. 22, 2001.

BACKGROUND OF THE INVENTION

This invention relates to an improved walker for use by persons having physical disabilities.

More specifically, this invention relates to an improved and safer walker having wheel assemblies that can traverse rough surfaces and roll over small obstacles without wheel drag.

Walkers are commonly used as a support by many of the frail aged and other persons with physical disabilities while they are moving from place to place. One typical walker in use today consists of a generally rectangular, tubular frame having four legs and open at the rear. In some variations of that walker design, all four legs terminate in caps or buttons that slide along or otherwise engage the floor or other walking surface. The invalid walker described in U.S. Pat. No. 4,135,535 is of such design, In another design variation, the two front walker legs are provided with wheels while the floor engaging ends of the rear legs terminate in a cap or button that slides along the floor or other surface as the user moves with the walker. The rear legs of this walker design tend to catch on minor surface irregularities and require the user to lift the rear of the walker to advance it, a task that often is difficult for many users. One approach to solving that problem has been to provide wheels on the rear walker legs as well as on the front. A full-wheeled walker is easier for a user to advance but also tends to be less stable, particularly when the user attempts to use the walker to aid or regain balance. That instability problem, in turn, has promoted efforts to provide a variety of braking systems that either act upon one or more of the walker wheels or rely upon an appendage to contact and drag along the floor or other walking surface. Examples of full-wheeled walkers that also incorporate a braking system include those described in U.S. Pat. Nos. 4,765,355, 5,020,560 and 6,068,273. A large variety of rolling (wheeled) walkers are available on the market today. Some are four wheeled and some are three wheeled. Many are adjustable in a variety of fashions and they include all kinds of features, such as baskets, bags, seats and brakes. Many of them fold for easy transportation. As can be appreciated, addition of baskets, bags, seats, brakes and the ability to fold increases greatly increases the cost.

None of the prior art walkers provide wheel means that can smoothly traverse small obstructions such as carpet edges, elevator doorways electrical cords, twigs and small branches, gravel, sidewalk irregularities and the like. This invention fills those needs.

Development of a rotating walker which can smoothly traverse small obstructions such as carpet edges, elevator doorways electrical cords, twigs and small branches, gravel, sidewalk irregularities and the like represents a great improvement in the field of walker designers and satisfies a long felt need of the disabled public.

SUMMARY OF THE INVENTION

The present invention is an improved rolling walker of the type having a frame, and a leading wheel, which has a low point, rotatably attached to the bottom of the frame at its front. The improvement comprises an intermediate wheel, which is rotatably attached to the bottom of the frame, close to and behind the leading wheel so that the low point of the intermediate wheel is lower than the low point of the leading wheel. Preferably the distance between the wheels is about ¼ inch and difference between the low points is also ¼ inch.

One way of making the low point of the intermediate wheel lower than the low point of the leading wheel is to make the axle of the intermediate wheel lower than the axle of the leading wheel. Another way of making the low point of the intermediate wheel lower than the low point of the leading wheel is to keep the axles at the same height but make the diameter of the intermediate wheel larger than the diameter of the leading wheel.

Hence, it is an object of this invention to provide a walker that rolls easily over small obstacles and is more maneuverable than are walkers of conventional design.

Other objects and advantages of this invention will become evident from a study of the following description and accompanying drawings.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
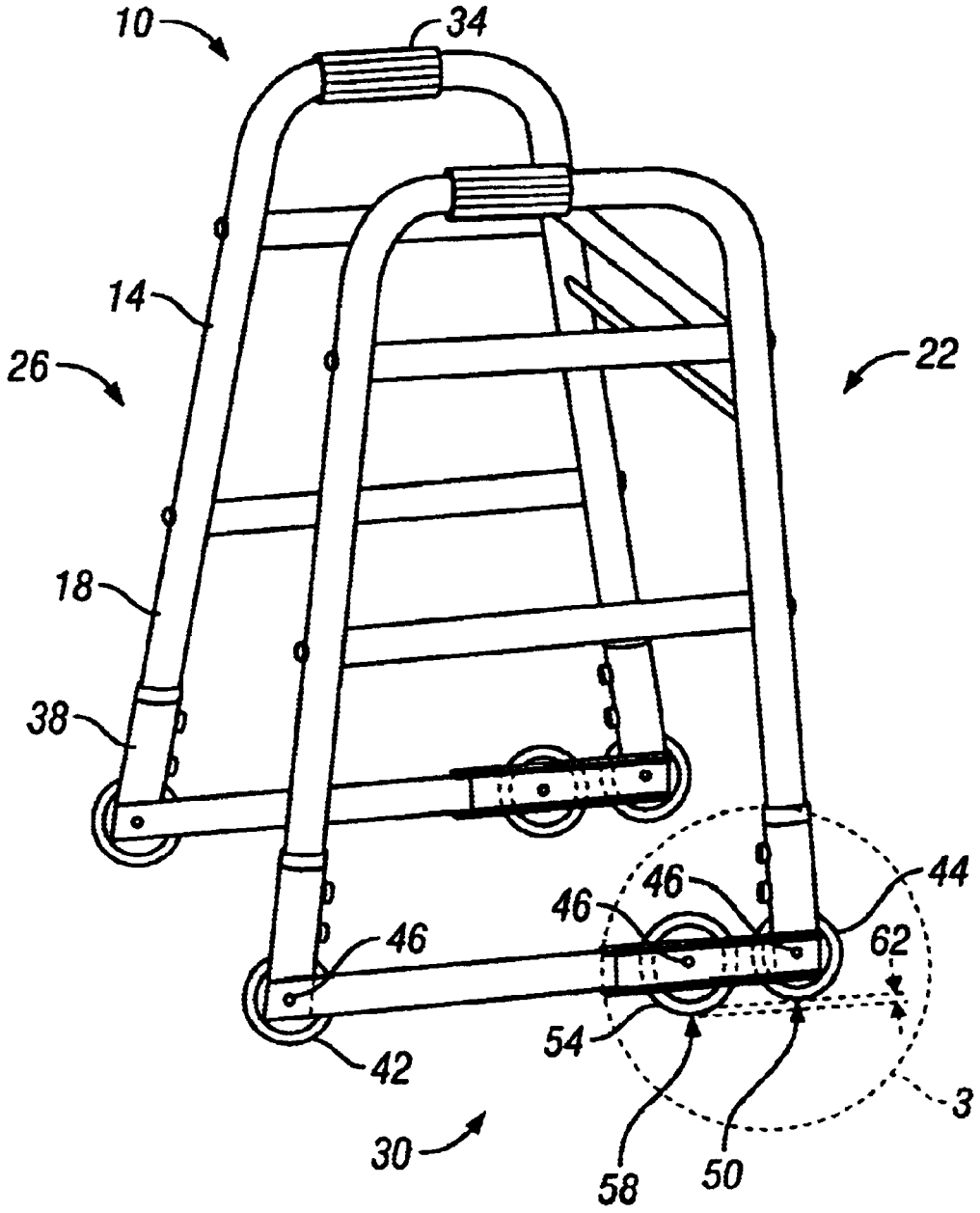
FIG. 1 is a three dimensional diagram of a four wheeled rolling walker adapted to negotiate uneven surfaces accordance with this invention.

FIG. 1 shows a wheeled rolling walker 10 which has been modified to negotiate uneven surfaces in accordance with this invention. All walkers 10 have a frame 14 with legs 18. They can be considered to have a front 22, a rear 26 and a bottom 30. They are made so that a person can enter the confines of the walker 10 from the rear 26 and grip the handles 34. The walker 10 illustrated on FIG. 1 has four legs 18. At the bottom 38 of each leg 18 is affixed a wheel 42, 44 on an axle 46. In other words there are two wheels 42 attached to the rear 26 of the frame 14 at its bottom 30 and two leading wheels 44 attached to the front 22 of the frame 14 at its bottom 30. Each leading wheel 44 has a low point 50. In prior art walkers this is the point on the wheel that contacts the ground. What has been described so far is no different from many rolling walkers on the market today. The problem with this type of walker is that it must be raised if the user encounters rough surfaces or small obstacles.

What distinguishes this walker 10 from other prior art walkers is a pair of intermediate wheels 54 attached on axles 42 behind the leading wheels 44. While these intermediate wheels 54 are attached between the leading 44 and rear 42 wheels, they are preferably close to the leading wheels 44. They should, preferably be attached so that there is at least ¼ inch but no more than a few inches between the leading 44 and intermediate 54 wheel. The intermediate wheels 54 are attached so that their low points 58 are lower than the low points 50 of the leading wheels 44. Preferably this difference in height 62 is ¼ inch.

Figure 3:
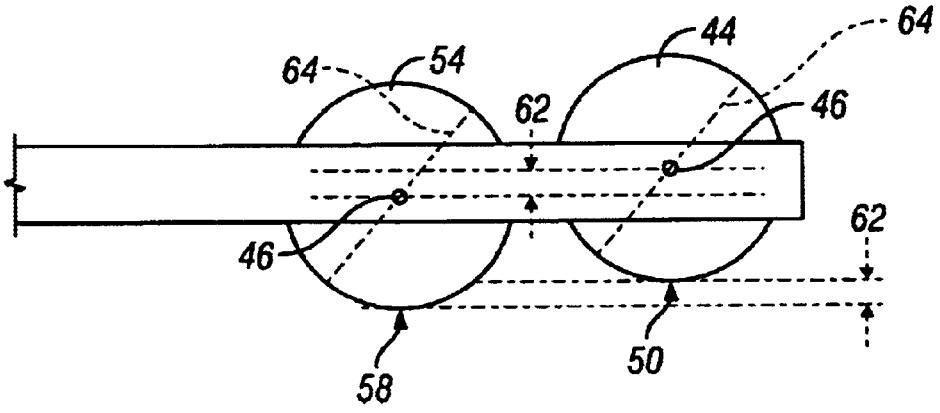
FIG. 3 is an enlarged view of the area indicated at 3 on FIG. 1, which illustrates making the axle of the intermediate wheel lower than the axle of the leading wheel.
Figure 4:
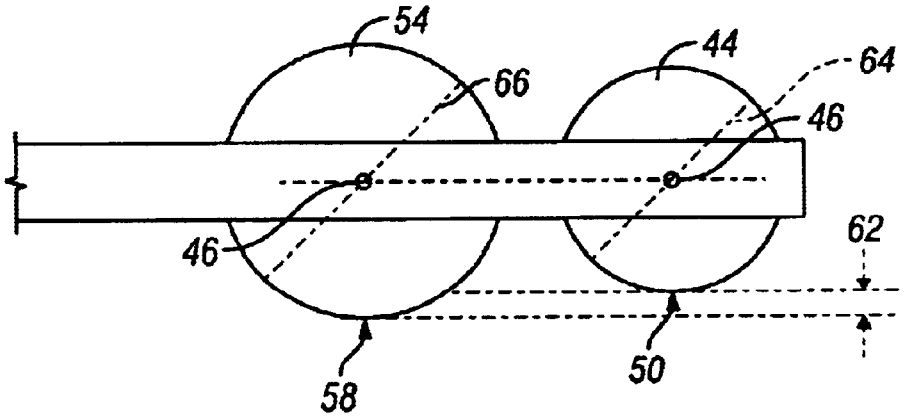
FIG. 4 illustrates the alternate method to that shown on FIG. 3 of keeping the axles at the same height but making the diameter of the intermediate wheel larger than the diameter of the leading wheel.

There are at least two ways of accomplishing this difference in height 62. See FIGS. 3 and 4. One way is use wheels 44,54 of the same diameter 64 but make the axle 46 of the intermediate wheel 54 lower, by the same distance 62, than the axle 46 of the leading wheel 44. This is illustrated in FIG. 3. The other way is to keep the axles 46 at the same height but use an intermediate wheel 54 with a diameter 66 greater than the diameter 64 of the leading wheel 44. The necessary diameter of the intermediate 54 wheel is easy to calculate from elementary geometry.

In either case, having two pairs of wheels 44, 54, close together, with a small difference 62 in their low points 50, 58 allows rolling walkers 10 made in accordance with this invention to smoothly traverse small obstructions such as carpet edges, elevator doorways electrical cords, twigs and small branches, gravel, sidewalk irregularities and the like. The intermediate wheel 54 will usually contact the ground at its low point 58 and the leading wheel 44 will roll over small obstructions as they are encountered, thus increasing the stability of the walker 10.

From the above description it will be seen that the inventive novelty of the rolling walker 10 of this invention is provision of two pairs of wheels 44, 54, close together at the bottom of 30 front 22 of the walker 10, with a small difference 62 in low points. Thus this inventive novelty can be applied to any prior art rolling walker. All that may be required is a special attachment bracket. Design and construction of such brackets are well known in the field of mechanical inventions.

Figure 2:
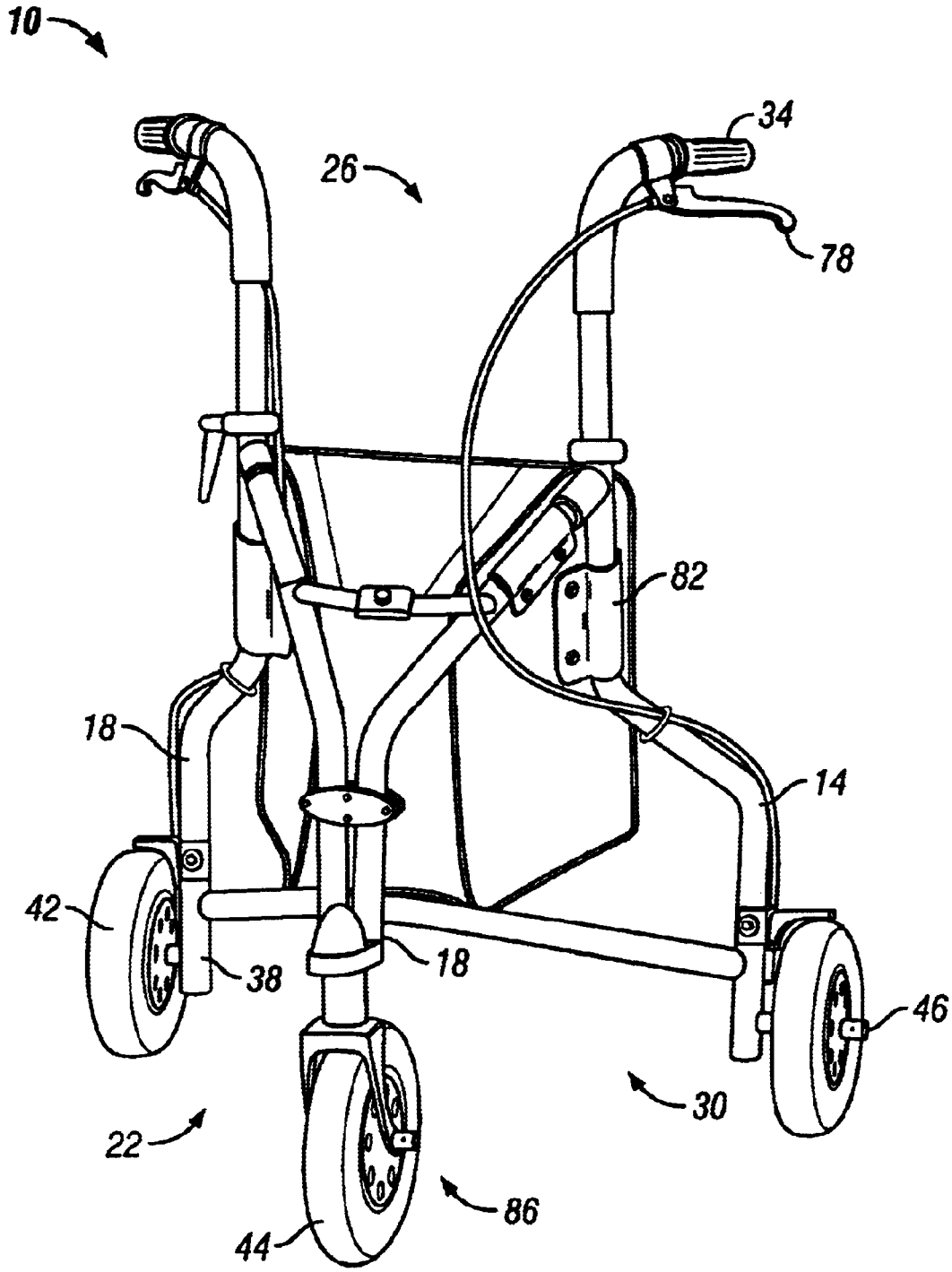
FIG. 2 (Prior Art)
FIG. 2 is a three dimensional view of a prior art three wheeled rolling walker
Figure 5:
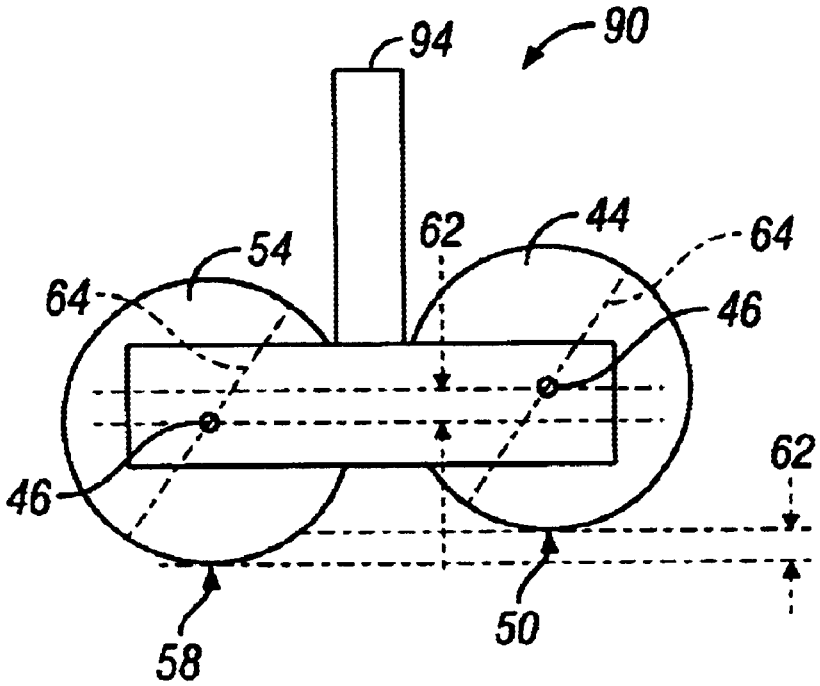
FIG. 5 illustrates a bogey with a leading and intermediate wheel for replacement of the front wheel assembly of a three wheeled walker. In this bogey the axle of the intermediate wheel lower the axle of the leading wheel.
Figure 6:
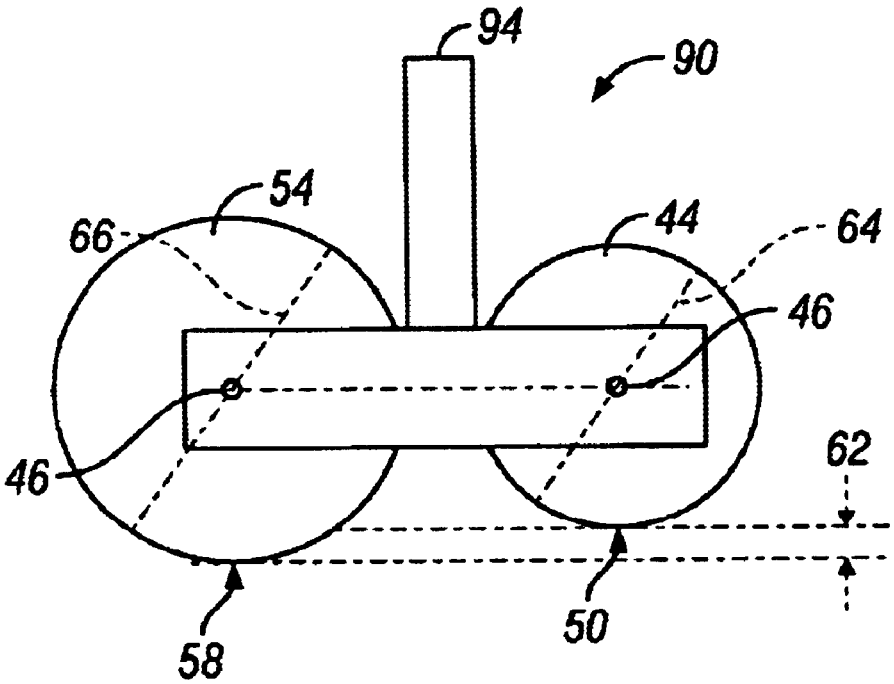
FIG. 6 illustrates an alternate embodiment bogey with a leading and intermediate wheel for replacement of the front wheel assembly of a three wheeled walker. In this bogey the axles are at the same height but the diameter of the intermediate wheel is larger than the diameter of the leading wheel.

This invention can, therefore, be applied to three wheeled walkers. A prior art three wheeled walker 10 is illustrated in FIG. 2. This particular design includes brakes 78 and a basket 82. The front wheel assembly 86, which includes the leading wheel 44 may be rotatable in the horizontal plane to ease steering of this walker 10. Bogeys 90 for replacement of this front wheel assembly 86 are illustrated in FIGS. 5 and 6. On FIG. 5 the wheels 44, 54 are the same diameter 64 but the axle 46 of the intermediate wheel 54 is lower than the axle 46 of the leading wheel 44. On FIG. 6 the axles 46 are at the same height but the diameter 66 of the intermediate wheel 54 is greater than the diameter 64 of the leading wheel 44. Again, the necessary diameter of the intermediate 54 wheel is easy to calculate from elementary geometry. The ascending member 94 is designed to attach to the frame 14, rotatably if desired.

The following reference numerals are used on FIGS. 1 through 6:

10 Rolling walker
14 Frame of rolling walker
18 Leg of rolling walker
22 Front of frame
26 Rear of frame
30 Bottom of frame
34 Handle
38 Bottom of leg
42 Rear wheel
44 Leading wheel
46 Axle
50 Low point of leading wheel
54 Intermediate wheel
58 Low point of intermediate wheel
62 Difference in point of contact and difference in heights of wheels and difference in heights of axles
64 Diameters of leading and intermediate wheels in case where diameters are equal
66 Diameter of intermediate wheel in case where diameter of intermediate wheel is larger than the diameter of the leading wheel
78 Brake
82 Bag
86 Front wheel assembly
90 Bogey
94 Ascending member Thus, the present invention has been described herein with reference to a particular embodiments for a particular applications. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. An improved rolling walker of the type having a frame, with four legs, which a persons enters from the rear; a rear wheel; and a leading wheel with a low point, rotatably attached to the bottom of said frame at its front; wherein the improvement comprises an intermediate wheel, said intermediate wheel being rotatably attached to said bottom, close to and behind said leading wheel so that its low point is lower than the low point of said leading wheel.

2. An improved rolling walker as claimed in claim 1 in which said intermediate wheel is larger in diameter than said leading wheel.

3. A rolling walker comprising:

a) a walker frame, said frame having a front, a rear and a bottom; said frame having four legs; said frame being entered from said rear;

b) a rear wheel, rotatably attached to the bottom at the rear rear of said walker frame;

c) a leading wheel, rotatably attached to the bottom at the front front of said walker frame; said leading wheel having a lead low point; and d) an intermediate wheel rotatably attached to the bottom of said walker frame intermediate said rear and leading wheels and close to said leading wheel; said intermediate wheel having an intermediate low point; said intermediate low point being lower than said lead low point.

4. A rolling walker as claimed in claim 3 in which said intermediate wheel is larger in diameter than said leading wheel.

5. A method of fabricating a rolling walker comprising:

a) fabricating a walker frame having four legs, said frame having a front, a rear and a bottom and being entered from said rear;

b) providing a rear wheel;

c) rotatably attaching said a rear wheel to the bottom rear of said walker frame;

d) providing a leading wheel having a lead low point;

e) rotatably attaching said leading wheel to the bottom front of said walker frame;

f) providing an intermediate wheel, having an intermediate low point; and g) rotatably attaching said intermediate wheel, to the bottom of said walker frame intermediate said rear and leading wheels and close to said leading wheel so that said intermediate low point is lower than said lead low point.

6. A method of fabricating a rolling walker as claimed in claim 5 in which said intermediate wheel is larger in diameter than said leading wheel.

* * * * *